United States Patent [19]

Mathews et al.

[11] Patent Number: 4,533,319

[45] Date of Patent: Aug. 6, 1985

[54] METHOD OF AND APPARATUS FOR MONITORING A ROTARY KILN ASSEMBLY

[75] Inventors: Clive A. Mathews, Preston; George M. Gillies, St. Annes, both of England

[73] Assignee: British Nuclear Fuels Limited, Warrington, England

[21] Appl. No.: 552,440

[22] Filed: Nov. 16, 1983

[30] Foreign Application Priority Data

Dec. 14, 1982 [GB] United Kingdom ..... 8235591

[51] Int. Cl.[3] ..... F27D 1/16; F27D 21/00; F27B 1/26

[52] U.S. Cl. ..... 432/3; 432/32; 432/36; 432/50; 432/115

[58] Field of Search ..... 432/4, 32, 36, 50, 115

[56] References Cited

U.S. PATENT DOCUMENTS

| | | | |
|---|---|---|---|
| 2,461,754 | 2/1949 | Mertz | 285/10 |
| 3,724,887 | 4/1973 | Roberts | 432/115 |
| 4,137,039 | 1/1979 | Stolzenberg | 432/4 |
| 4,193,756 | 3/1980 | Leon | 432/3 |
| 4,199,154 | 4/1980 | Mueller | 277/53 |
| 4,295,824 | 10/1981 | Wens | 432/115 |

FOREIGN PATENT DOCUMENTS

| | | |
|---|---|---|
| 1192967 | 5/1965 | Fed. Rep. of Germany . |
| 720901 | 12/1954 | United Kingdom . |

*Primary Examiner*—John J. Camby
*Attorney, Agent, or Firm*—William R. Hinds

[57] ABSTRACT

A problem that can occur with a large rotary kiln assembly is that it can move out of position or seals can become defective, making an escape of materials possible. The present invention provides transducers (10, 15) for detecting movement of the rotary kiln itself or part of a seal assembly secured thereto relative to an inlet/-outlet arrangement of the kiln assembly or a part of a seal arrangement secured thereto and also means whereby the condition of the seals can be monitored by following changes in the pressure or flow rate of a purge gas. If the rotary kiln (2) should move out of alignment, then corrective action can be taken. If the seals should leak, then they are changed. A record of kiln movement is provided and if movement is excessive, an alarm (20) is sounded.

6 Claims, 3 Drawing Figures

METHOD OF AND APPARATUS FOR MONITORING A ROTARY KILN ASSEMBLY

This invention relates to a method of and apparatus for monitoring a rotary kiln assembly.

BACKGROUND OF THE INVENTION

Rotary kiln assemblies, which may be used for gas/-liquid/solid counter or co-current reactions comprise an inlet arrangement, the rotary kiln itself and an outlet arrangement. It is to be understood that materials can be fed into or extracted from either the inlet arrangement or outlet arrangement. Seal arrangements are needed between the inlet arrangement/rotary kiln and between the rotary kiln/outlet arrangement so that loss of valuable materials can be avoided and, in the case of unpleasant or toxic substances, escape of materials may be prevented.

Rotary kiln assemblies contain materials which may have to react at hundreds of degrees Celsius, so that thermal expansion of the rotary kiln must be taken into account during design of the rotary kiln assembly. There is, however, a problem because thermal expansion takes place, and different parts of the kiln assembly are heated to different temperatures causing temperature gradients and the possibility of differing non-axial thermal expansion movement of different parts of the assembly, which can allow damage to the aforementioned seal arrangements, making loss of materials and plant down-time a possibility.

An object of the present invention is to seek to provide a method of and apparatus for monitoring a rotary kiln assembly so that, when necessary, the aforementioned problem can be mitigated.

SUMMARY OF THE INVENTION

According to one aspect of the present invention, there is provided a method of monitoring a rotary kiln assembly which comprises on a common longitudinal axis an inlet arrangement, the rotary kiln itself, an outlet arrangement and seal arrangements between the rotary kiln/inlet arrangement and between the rotary kiln/outlet arrangement, the method comprising arranging transducers to detect movement of part of the rotary kiln near to a seal arrangement or of part of the seal arrangement rotatable with the rotary kiln, which movement is not restricted to movement on the common longitudinal axis and is relative to the inlet or outlet arrangement or to a part of the seal arrangement secured thereto, transmitting from said transducers to a monitoring arrangement signals generated by said movement, and monitoring said signals with the monitoring arrangement.

Preferably, the monitoring arrangement generates an alarm signal if movement should be outside a preselected limit. The preselected limit may be at maximum misalignment tolerance of the seal arrangements.

Advantageously the monitoring arrangement is also arranged to detect pressure and flow rate of purge gas in said seal arrangements. Outlet pressure of purge gas may be measured, thereby avoiding a pressure measurement which is non-representative of seal integrity because of flow blockage in the seal arrangement.

According to another aspect of the present invention there is provided apparatus for monitoring a rotary kiln arrangement which comprises aligned on a common axis the rotary kiln itself, inlet and outlet arrangement for the kiln, and seal arrangements disposed between the rotary kiln/inlet arrangement and rotary kiln/outlet arrangement, the apparatus comprising a number of displacement transducers, each transducer so disposed between a part of the rotary kiln near to a seal arrangement, or a part of the seal arrangement rotatable with the rotary kiln, and either the inlet or outlet arrangement, or a part of the seal arrangement secured thereto, to generate signals indicative of detected relative displacement, and a monitoring arrangement arranged to receive signals for said transducer.

Thus, proximity of metal to metal contact between relatively moving parts of the kiln assembly may be determined together with closeness to maximum misalignment tolerance of the seal assemblies.

Advantageously, seal fail detection means is also provided in seal arrangements in the rotary kiln assembly. Conveniently, said seal failure detection means provides a signal indicative of any detected failure by generating a signal representative of pressure and flow rate of purge gas in the seal arrangements, which signal is fed to said monitoring arrangement.

DESCRIPTION OF DRAWINGS

An embodiment of the present invention will now be described, by way of example only, with reference to the accompanying drawings in which.

DESCRIPTION OF PREFERRED EMBODIMENT

Figure 1:
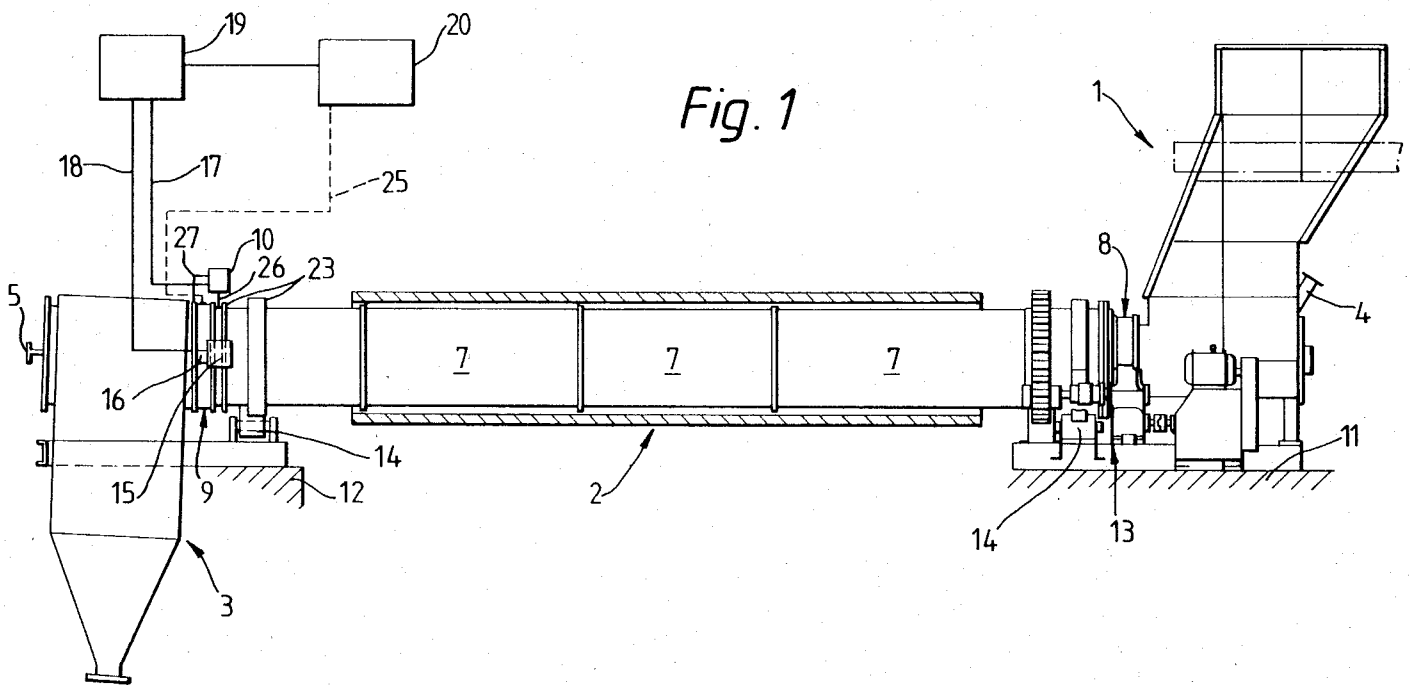
FIG. 1 is a diagrammatic view of a rotary kiln arrangement.

Reference is directed firstly to FIG. 1, in which a rotary kiln assembly is shown to comprise an inlet arrangement 1, a rotary kiln 2 and an outlet arrangement 3 aligned on a common longitudinal axis. The inlet arrangement includes a solid material feed inlet 4 and the outlet arrangement includes a material inlet 5. The rotary kiln assembly itself includes a number of separately temperature-controllable sections 7, so that a desired temperature profile can be obtained within the kiln. Different parts of the kiln assembly, such as inlet arrangement 1, rotary kiln 2 and outlet arrangement 3, can be heated/cooled by different means (not shown) such that they are at different temperatures.

A seal arrangement 8 is disposed between the inlet arrangement 1 and the rotary kiln 2. A seal arrangement 9 is disposed between the rotary kiln 2 and an outlet arrangement 3. The kiln assembly is supported on concrete supports 11 and 12, to the right and left of the Figure, respectively. A drive arrangement 13 is disposed so as to be able to rotatably drive the rotary kiln 2. The rotary kiln is rotatably mounted on two support rollers 14.

The rotary kiln assembly may operate in a range of temperature extending from room temperature to hundreds of degrees Celsius, so that allowance must be made for thermal expansion of components within the kiln assembly as different parts at different temperatures cause differential thermal expansion. In particular, the rotary kiln 2 is likely to expand differentially to the inlet and outlet arrangements 1 and 3. Therefore, the seal arrangements 8 and 9 allow for relative movement between the inlet arrangement 1, rotary kiln 2 and outlet arrangement 3. The support arrangement for the kiln assembly allows for longitudinal movement of the rotary kiln 2, the mounting arrangement being axially fixed only at the drive end. However, with differential temperatures and fluctuating thermal gradients it is possible that relative movement not restricted to movement on a common longitudinal axis can occur between the rotary kiln 2/outlet arrangement 1/outlet arrangement 3. Such a possibility is made more likely because of other contributing factors such as wear on rollers/-bearings, restraining of some parts and not others, differing mounting distances of parts from supports and eccentricities in rotating components. The seal arrangements 8 and 9 have a maximum misalignment tolerance and it is important to ensure that metal to metal contact of relatively moving parts is avoided. There is a further constraint on the system, in that the seal arrangements 8 and 9 are arranged to permit their removal and replacement, for maintenance purposes and in case of breakdown, without changing axial displacement between the rotary kiln 2 and the outlet arrangement 3.

Figure 2:
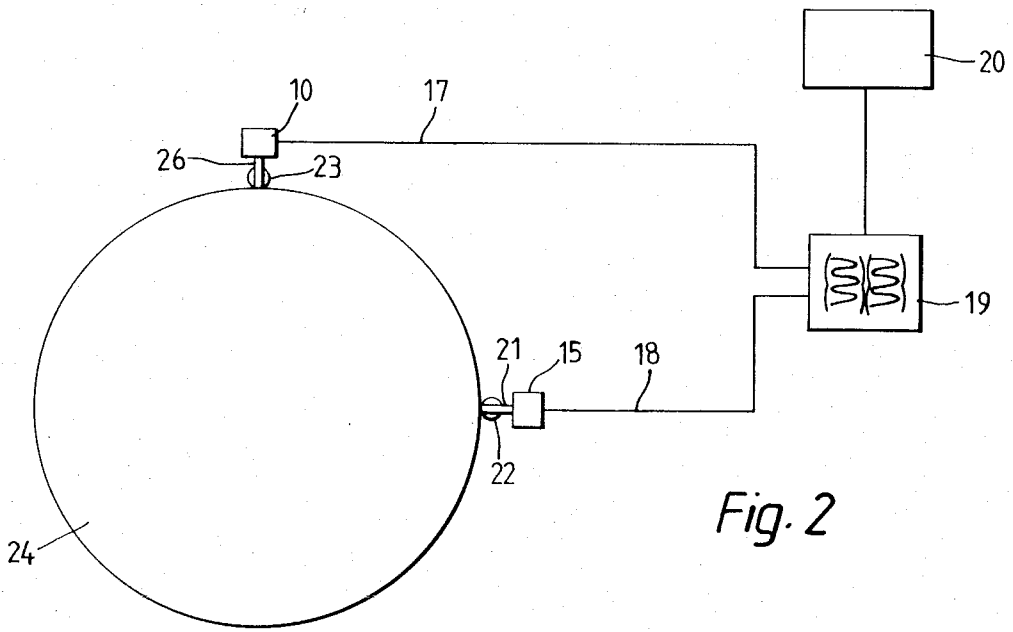
FIG. 2 is an incomplete diagrammatic section of the arrangement of FIG. 1.

An inductance-type transducer 10, having an arm 26 which carries a roller 23 is secured by a bracket 27 to a part of the seal arrangement 9 which is secured to the outlet arrangement 3. The roller 23 bears upon part 24 of the seal arrangement (which rotates with the kiln 2) and is positioned at 12 o'clock on the rotary kiln. A similar transducer 15 having an arm 21 and a roller 22 (shown only in FIG. 2) is secured by a bracket 16 in a similar manner at the 3 o'clock position. These positions are shown more clearly in Figure 2. The transducers are each arranged to generate an electrical signal indicative of the displacement of the fixed part of the seal arrangement 9 relative to the moving part of the seal arrangement 9. Movement of the transducer arms causes a change of flux linkage in coils carried in the transducers 10, 15.

The signals from the transducer 10 and the transducer 15 are fed along lines 17, 18 respectively to a recording, processing and display device 19. The device 19 is able to give an alarm output to an alarm 20 in order to alert personnel if the indicated movement is outside preselected limits. The limits conventiently define tolerance limits for safe operation of the seal arrangement 9 and for safe proximity between relatively rotating metal parts. An initial datum is set with the rotary kiln assembly running cold and with parts 1, 2, 3 co-axial.

Figure 3:
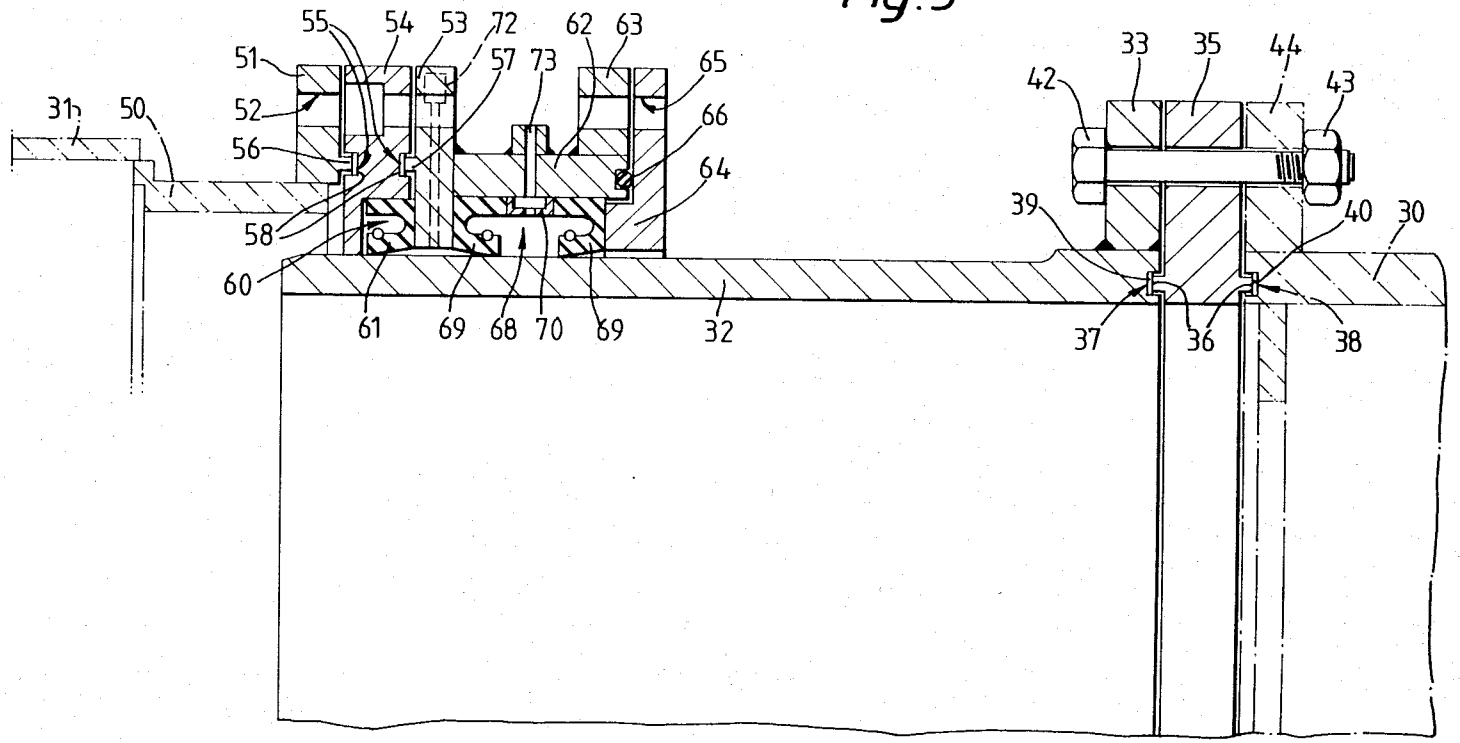
FIG. 3 is a sectional view of part of a seal arrangement used in the kiln of FIG. 1.

Referring again to FIG. 1 a gas line from the seal arrangement 9 to the alarm 20 is indicated by 25. This line holds a nitrogen purge gas and the pressure of the gas and its flow rate through the seal arrangement, as explained below in relation to FIG. 3, is monitored. If it varies outside a preselected range the seal integrity is questionable so that the seal arrangement is checked/replaced. Outlet pressure rather than inlet pressure is monitored so that any risk of a misleadingly high pressure reading owing to blockage in the seal/input line is avoided.

Reference is now directed to FIG. 3, wherein the upper part of the seal arrangement 9 is shown in more detail. In FIG. 3 a wall of the rotary kiln 2 is indicated by 30 and a wall of the outlet arrangement 3 by 31. The seal arrangement 9 includes a cylinder 32 of similar diameter to the kiln 30. The arms and rollers of the aforementioned transducers 10, 15 can conveniently bear upon this cylinder, indicated generally in FIG. 2 by the reference numeral 24. The cylinder 32 carries a welded flange 33 and the kiln wall 30 carries a flange 44. A spacer 35 comprising a ring member is disposed between the kiln wall 30 and cylinder 32. The spacer has square section annular spigots 36 on either side thereof. One of the spigots 36 engages in a recess 37 in the cylinder 32, and the other engages in a recess 38 in the rotary kiln wall 30 to provide a seal and assist with alignment. Seal rings 39 and 40 are disposed in recesses 37 and 38, respectively. The cylinder 32 is secured to the kiln wall 30 by means of bolts 42, engaged by nuts 43, so that the spacer 35 is retained therebetween. In a cold condition, the axial length of the cylinder 32 and spacer 35 is sufficient to enable a closed passageway to be provided from the wall 30 to within an annulus 50 forming part of the outlet arrangement 3. As the kiln increases in temperature, the cylinder 32 is moved leftwardly in FIG. 3 so that the cylinder moves further into the outlet arrangement 3. In the cold condition the cylinder 32 does not have sufficient axial length, itself, to extend all the way from the rotary kiln 30 to within the annulus 50, that is, if there were no spacer member 35 present.

The annulus 50 carries a flange 51 welded thereto. The flange 51 is bolted by bolts (not shown) which pass through bores 52 to a seal support member 53, via a flange 54. The bodies of the transducers 10, 15 can conveniently be secured to any of these stationary parts. The flange 54 contains recesses 55 which are engaged by a spigot 56 on the flange 51 and a spigot 57 on the suport member 53. Seals 58 are disposed in the recesses 55. An annular cavity 60 is defined by the flange 54, support member 53 and cylinder 32. A lip seal 61 is arranged within this cavity. The lip seal 61 bears upon the cylinder 32 to effect a seal between the fixed flange 54 and the rotating cylinder 32. The support member 53 has an annulus 62 welded thereto. This annulus carries a flange 63 and an L-section flange 64 can be bolted to the flange 63 via a bore 65. An O-ring seal 66 is trapped between the L-section flange 64 and the flange 63. The support member 53, annulus 62 and L-section flange 64 define an annular cavity 68. The annular cavity 68 contains two lip seals 69, separated by a lantern ring 70. The lip seal 69 provide a material-tight seal between the stationary annulus 62 and the rotating cylinder 32, even when cylinder 32 moves axially due to thermal expansion of the kiln. Inert gas purge inlet channels 72 and 73 are provided for pressurising the gaps between the lip seals 61 and 69 and similar outlet channels (not shown) are provided on the opposite side of the seal arrangement. These outlet channels connect with the line 25 (FIG. 1) which includes pressure and flow rate measurement means (not shown) so that the inert gas pressure and flow rate can be monitored as mentioned above in connection with FIG. 1.

From the foregoing, it can be seen that the present invention provides a means whereby misalignment and failure of the seal arrangement 9 can be monitored and corrective action taken. In other embodiments of the invention a capacitive type transducer or a laser type transducer could be used in place of the inductive transducers 10 and 15, as could a resistive, ultrasonic, radar or any other type.

We claim:

1. A method of monitoring a rotary kiln assembly which comprises, on a common longitudinal axis, a rotary kiln, an inlet arrangement for the kiln, an outlet arrangement for the kiln, seal means between the inlet arrangement and the kiln, further seal means between the kiln and the outlet arrangement, each of the seal means and the further seal means having a part rotatable with the kiln and another part secured to the respective inlet or outlet arrangement, the method comprising disposing a plurality of displacement transducers to detect relative displacement between the kiln and said inlet and outlet arrangements, which relative displacement is not restricted to movement in the common axis, transmitting from said transducers to a monitoring arrangement signals generated by said relative displacement, and monitoring said signals with the monitoring arrangement.

2. A method as claimed in claim 1 in which the monitoring arrangement generates an alarm signal if relative displacement should be outside a preselected limit.

3. A method as claimed in claim 1 in which purge gas is supplied to said seal means, and the monitoring arrangement is arranged to detect changes in pressure and flow rate of purge gas in the seal means.

4. Apparatus for monitoring a rotary kiln arrangement comprising, on a common longitudinal axis, a rotary kiln, an inlet arrangement for the kiln, an outlet arrangement for the kiln, seal means between the inlet arrangement and the kiln, further seal means between the kiln and the outlet arrangement, each of the seal means and the further seal means having a part rotatable with the kiln and another part secured to the respective inlet or outlet arrangement, a plurality of displacement transducers disposed to detect relative displacement between the kiln and said inlet and outlet arrangement for generating signals indicative of detected relative displacement, the relative displacement being not restricted to movement in the common axis, and monitoring means arranged to receive signals from said displacement transducers.

5. Apparatus as claimed in claim 4 further comprising seal failure detection means for detecting wear and failure of said seal means.

6. Apparatus as claimed in claim 5 in which purge gas is supplied to said seal means, and said seal failure detection means comprises means for measuring the pressure and flow rate of purge gas in the seal means, means for generating signals indicative of changes in said pressure and flow rate, and means for feeding the signals to said monitoring means.

* * * * *